US009938719B2

(12) United States Patent
Derleth

(10) Patent No.: US 9,938,719 B2
(45) Date of Patent: Apr. 10, 2018

(54) STRUCTURAL INSULATED PANELS WITH HIDDEN DOVETAIL JOINTS

(71) Applicant: Jason Derleth, Alexandia, VA (US)

(72) Inventor: Jason Derleth, Alexandia, VA (US)

( * ) Notice: Subject to any disclaimer, the term of this patent is extended or adjusted under 35 U.S.C. 154(b) by 0 days.

(21) Appl. No.: 15/260,780

(22) Filed: Sep. 9, 2016

(65) Prior Publication Data

US 2018/0073248 A1 Mar. 15, 2018

(51) Int. Cl.

| | |
|---|---|
| ***E04B 2/08*** | (2006.01) |
| ***E04C 2/28*** | (2006.01) |
| ***E04B 1/61*** | (2006.01) |
| ***E04B 1/41*** | (2006.01) |
| ***E04C 2/52*** | (2006.01) |
| ***E04B 1/14*** | (2006.01) |
| ***E04B 5/48*** | (2006.01) |
| ***E04B 9/04*** | (2006.01) |
| ***E04B 2/00*** | (2006.01) |
| ***E04B 5/02*** | (2006.01) |

(52) U.S. Cl.

CPC ..... *E04C 2/28* (2013.01); *E04B 1/14* (2013.01); *E04B 1/40* (2013.01); *E04B 1/54* (2013.01); *E04B 1/61* (2013.01); *E04B 5/48* (2013.01); *E04B 9/0421* (2013.01); *E04B 9/0435* (2013.01); *E04C 2/46* (2013.01); *E04C 2/50* (2013.01); *E04C 2/521* (2013.01); *E04B 2001/6195* (2013.01)

(58) Field of Classification Search

CPC ..... E04B 1/14; E04B 1/40; E04B 1/54; E04B 1/61; E04B 5/48; E04B 9/0421; E04B 9/0435; E04B 2001/6195; E04C 2/28; E04C 2/46; E04C 2/50; E04C 2/521; Y10T 403/7045; Y10T 403/7094

USPC ..... 52/220.3, 590.1, 590.2, 590.3

See application file for complete search history.

(56) References Cited

U.S. PATENT DOCUMENTS

| | | | | |
|---|---|---|---|---|
| 1,067,910 A * | 7/1913 | Florey | F16B 12/46 | 296/29 |
| 1,122,350 A * | 12/1914 | Wysong | 144/347 | |
| 1,424,481 A * | 8/1922 | Isoardi | F16B 12/04 | 217/65 |
| 2,520,221 A * | 8/1950 | Ponty | E04B 1/6179 | 403/314 |

(Continued)

FOREIGN PATENT DOCUMENTS

| | | |
|---|---|---|
| DE | 102010045023 A1 | 3/2012 |
| FR | 2815678 A1 | 4/2002 |

OTHER PUBLICATIONS

"Insulated Roof & Wall Systems", OPTIMO, Issue 3: Jan. 2016, www.kingspanpanels.us/www.kingspanpanels.ca, 16 pages.

(Continued)

*Primary Examiner* — Charles A Fox
*Assistant Examiner* — James J Buckle, Jr.
(74) *Attorney, Agent, or Firm* — Ziegler IP Law Group, LLC

(57) ABSTRACT

The disclosed subject matter relates to building panel including an end portion along one perimeter side thereof and a dovetail configuration along the end portion. The disclosed subject matter also relates to joints formed between such building panel, electrical/telecommunications, plumbing and HVAC chases and conduits in the building panels and procedures for manufacturing the building panels.

8 Claims, 8 Drawing Sheets

(56) References Cited

U.S. PATENT DOCUMENTS 2,691,242 A * 10/1954 Young ..... A63H 33/082 446/115
2,882,714 A * 4/1959 Gagle ..... E04F 15/10 405/270
3,220,151 A * 11/1965 Goldman ..... E04C 2/044 428/156
3,228,162 A * 1/1966 Gregoire ..... E04C 2/26 52/309.9
3,692,201 A * 9/1972 Garduna ..... B65D 9/34 217/12 R
4,025,215 A 5/1977 Murdock et al.
4,628,653 A 12/1986 Nash
4,809,755 A * 3/1989 Pontikas ..... B27F 1/12 144/144.51
5,114,265 A * 5/1992 Grisley ..... B27F 1/12 144/144.1
5,357,728 A * 10/1994 Duncanson ..... A47B 47/042 403/381
5,588,726 A * 12/1996 Lee ..... F16B 12/02 312/263
5,927,032 A 7/1999 Record
6,352,657 B1 * 3/2002 Veldhuis ..... B28B 19/003 264/259
6,357,194 B1 * 3/2002 Jones, Jr. ..... F16B 12/125 248/223.41
6,427,414 B1 * 8/2002 Wing ..... E04F 13/10 52/233
7,225,543 B2 6/2007 Kennedy et al.
7,963,038 B2 * 6/2011 Schmitz ..... B64C 9/02 29/428
8,201,600 B2 6/2012 Birkett et al.
2013/0305650 A1 11/2013 Liu

OTHER PUBLICATIONS

"Secret Miter Dovetaild", The Woodwrights Guide: Working Wood with Wedge & Edge, Roy Underhill, http://www.pbs.org/woodwrightsshop/project-guides/cabinet-maker/secret-miter-dovetail/, Copyright 2012 The University of North Carolina Press, 4 pages.

* cited by examiner

STRUCTURAL INSULATED PANELS WITH HIDDEN DOVETAIL JOINTS

FIELD OF THE INVENTION

This invention relates to structural insulated building panels used in building construction.

BACKGROUND

Historically, normal lumber construction utilizes lumber members and nails that are used to construct a building structure, such as, for example, a house. Lumber constructed structures are built by hand, but the process is slow and requires skilled labor such as highly trained carpenters and other skilled professionals. Such construction can require many hours of work in the outside elements (such as rain, snow. etc.), use a natural resource that can be of limited supply and may result in a structure that is less energy efficient because of inconsistencies in the quality of the build. An alternative approach employs steel studs. This approach also suffers from limitations in that the steel studs are difficult to work with and are good thermal conductors of heat through walls and roofs.

Structural insulated panels (SIPs) are a modern building material used in home and other modular building construction. Several factors have hampered the wide-spread use of SIPs in current building construction. SIPs require a substantial amount of pre-planning in order to result in an efficient construction process. This is because SIPs are not easily handled or customized in the field at a construction site. For example, in order to cut or otherwise modify SIP, special tools are required that may not be easily utilized in the field. Also, more precise planning and building techniques may be needed because SIPs are difficult to modify in the field. A further complicating factor is that SIPs are usually heavy and generally require the use of heavy equipment such as cranes.

BRIEF DESCRIPTION

In one embodiment, a building panel is provided. The building panel includes an inner rigid panel; an outer rigid panel; a foam core therebetween the inner rigid panel and the outer rigid panel; four perimeter sides; an end portion along one perimeter side of the building panel; two side portions each along two other perimeter sides of the building panel, each of the side portions abutting the end portion at one end thereof; and a dovetail configuration along the end portion. The dovetail configuration includes the outer rigid panel having a beveled surface along the length of the end portion, the beveled surface having an outside edge and an inside edge, the outside edge coincident with the exterior surface of the outer rigid panel; each side portion including a side end facing surface at substantially the same angle as the beveled surface of the outer rigid panel and extensive of the beveled surface from the inside edge of the beveled surface at one end of each side end facing surface; and a tenon and mortise dovetail along the length of the end portion in between the side portions, the tenon and mortise dovetail comprising a plurality of alternating tapered tenons and tapered mortises, said tapered tenons including a plurality of substantially flat sides and an inner rigid panel portion and a foam core portion, said tapered mortises.

In another embodiment, a building panel is provided. The building panel includes an inner rigid panel including an exterior surface; an outer rigid panel including an exterior surface; a foam core therebetween the inner rigid panel and the outer rigid panel; four perimeter sides; an end portion along one perimeter side of the building panel; two side portions each along two other perimeter sides of the building panel, each of the side portions abutting the end portion at one end thereof; and a dovetail configuration along the end portion. The dovetail configuration includes the outer rigid panel having a beveled surface along the length of the end portion, the beveled surface having an outside edge and an inside edge, the outside edge coincident with the exterior surface of the outer rigid panel; each side portion including a side end facing surface at substantially the same angle as the beveled surface of the outer rigid panel and extensive of the beveled surface from the inside edge of the beveled surface at one end of each side end facing surface, the side end facing surface including an inner rigid panel portion and a foam core portion; and a tenon and mortise dovetail along the length of the end portion in between the side portions. The tenon and mortise dovetail includes a plurality of tapered tenons and a plurality of tapered mortises in one of two configurations. A first configuration wherein the plurality of tapered tenons include inner tenons and end tenons, each inner tenon and end tenon including a plurality of substantially flat sides comprising an interior face that is coplanar to and includes the exterior surface of the inner rigid panel, two side faces normal to the interior face that include an inner rigid panel portion and a foam core portion and an end face normal to the interior face that include an inner rigid panel portion and a foam core portion, each inner tenon positioned between two mortises on either side thereof, each end tenons positioned adjacent one of the side end facing surfaces of the side portions, the two side faces of each end tenon including an internal side face and an external side face, the external side face positioned adjacent the side portion of one of the side end facing surfaces; and each mortise of the plurality of tapered mortises includes a plurality of substantially flat sides defined by the side faces of tenons on either side thereof, a root face normal to the inside edge of the outer rigid panel's beveled surface and an inner face normal to the exterior surface of the inner rigid panel, the root face including an inner rigid panel portion and a foam core portion. A second configuration wherein each tenon of the plurality of tenons includes a plurality of substantially flat sides comprising an interior face that is coplanar to and includes the exterior surface of the inner rigid panel, two side faces normal to the interior face, each side face including an inner rigid panel portion and a foam core portion and an end face normal to the exterior face that includes an inner rigid panel portion and a foam core portion; and the plurality of tapered mortises include inner mortises and end mortises, each inner mortise and end mortise includes a plurality of substantially flat sides defined by a root face normal to the inside edge of the outer rigid panel's beveled surface and an inner side normal to the exterior surface of the inner rigid panel, the root face including an inner rigid panel portion and a foam core portion, each inner mortise further defined by the side faces of tenons on either side thereof, the end mortises further defined by the side face of a tenon on one side and an inner wall of the side end facing surface on the other.

In another embodiment, a method of modifying a building panel is provided. The building panel includes an inner rigid panel; an outer rigid panel; a foam core therebetween the inner rigid panel and the outer rigid panel; four perimeter sides; an end portion along one perimeter side of the building panel; and two side portions each along two other perimeter sides of the building panel, each of the side portions abutting the end portion at one end thereof. The method includes forming at least one chase in the foam core of the building panel; installing an electrical conduit, a telecommunication conduit or a plumbing conduit in the at least one chase of the building panel; and forming a dovetail configuration along the end portion of the building panel. The dovetail configuration including the outer rigid panel having a beveled surface along the length of the end portion, the beveled surface having an outside edge and an inside edge, the outside edge coincident with the exterior surface of the outer rigid panel; each side portion including a side end facing surface at substantially the same angle as the beveled surface of the outer rigid panel and extensive of the beveled surface from the inside edge of the beveled surface at one end of each side end facing surface; and a tenon and mortise dovetail along the length of the end portion in between the side portions, the tenon and mortise dovetail comprising a plurality of alternating tapered tenons and tapered mortises, said tapered tenons including a plurality of substantially flat sides and an inner rigid panel portion and a foam core portion, said tapered mortises.

Further suitable embodiments of the invention are described in the dependent claims.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

A description of preferred embodiments of the invention follows. It will be understood that the particular embodiments of the invention are shown by way of illustration and not as limitations of the invention. At the outset, the invention is described in its broadest overall aspects, with a more detailed description following. The features and other details of the compositions and methods of the invention will be further pointed out in the claims.

SIPs can be used in building construction by interconnecting multiple SIPs to form different building sections. An SIP is a wall or other building panel having a foam core sandwiched between two rigid panel faces. The rigid panel faces are generally formed from conventional building materials such as gypsum or cementitious composites, plywood, oriented strand board (OSB), drywall, or other rigid construction boards that may range in thickness from ¼ in. to ¾ in. or in some instances thicker. The foam core provides insulation may be composed of, for example, polyurethane, polystyrene range in thickness from 1 in. to 12 in. or in some instances thicker. The rigid panels may be affixed to the foam core using conventional bonding materials or adhesives including, for example, urethane cement or glue. SIPs may vary in thickness from several inches to over a foot. The size of SIP panels may vary from several feet (e.g., 4 ft.) to 24 feet or larger in width and from 8 feet to 9 feet or larger in height. SIPs are structural in nature and can be load-bearing. As such they can be used for interior and exterior building walls, floors, ceilings, roofs and other structural components of a building.

Figure 1A:
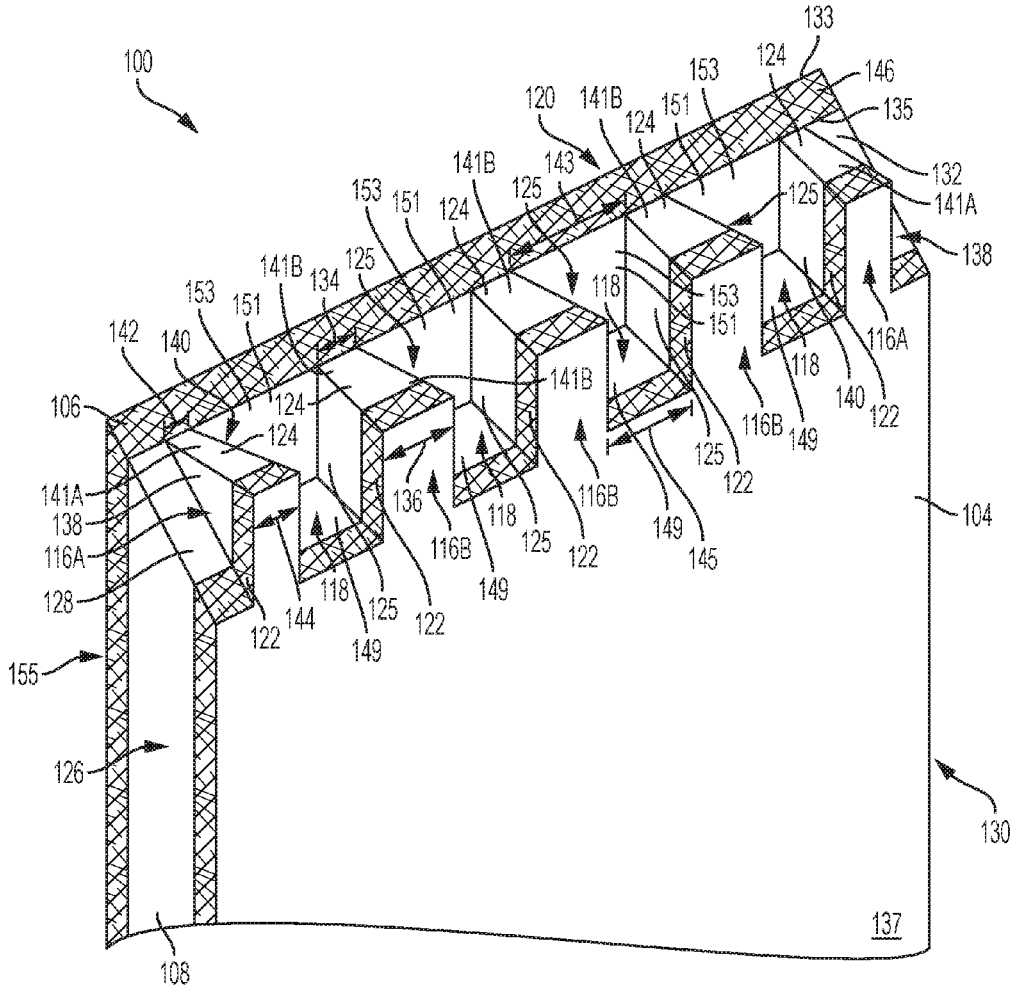
FIG. 1A is a perspective view illustrating an embodiment of one of two building panels to be joined.
Figure 1B:
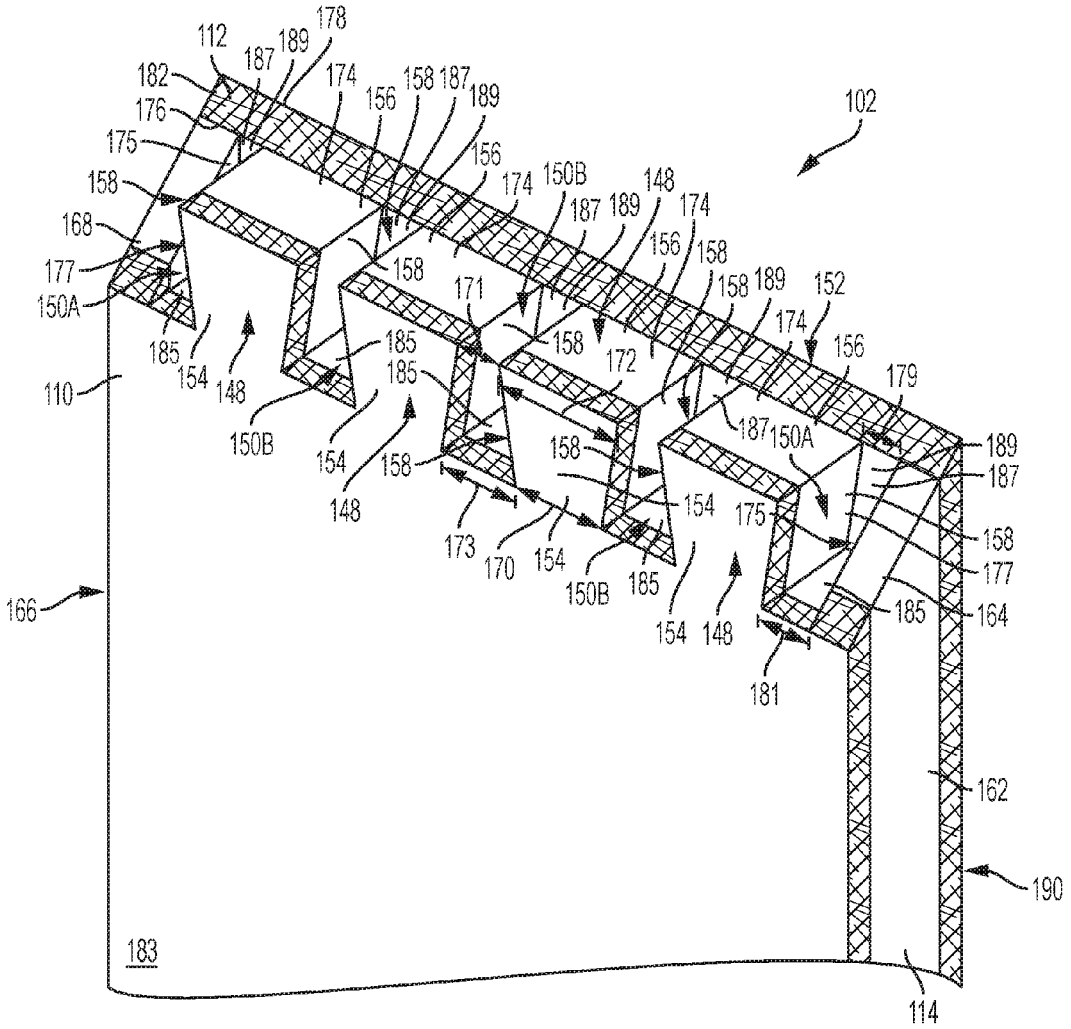
FIG. 1B is a perspective view illustrating an embodiment of the other of the two building panels to be joined.

FIGS. 1A, 1B and IC illustrate an embodiment of a joint for connecting SIPs 100 and 102 at the end portions thereof. SIP 100 includes inner rigid panel 104, outer rigid panel 106 and foam core 108 with inner rigid panel 104 and outer rigid panel 106 substantially parallel to one another. SIP 102 includes inner rigid panel 110, outer rigid panel 112 and foam core 114 with inner rigid panel 110 and outer rigid panel 112 substantially parallel to one another.

SIP 100 also includes a plurality of tenons 116A and 116B and a plurality of mortises 118 that alternate and are positioned along the length of end portion 120 that is one perimeter side of the SIP such that end tenons 116A are positioned adjacent side portions 126 and 130 with inner tenons 116B positioned therebetween along the length of end portion 120. Side portions 126 and 130 are each along two other perimeter sides of the SIP, each of the side portions abutting the end portion 120 at one end thereof. Tenons 116B are all generally the same size and each have a plurality of substantially flat sides. End tenons 116A are both generally the same size and each have a plurality of substantially flat sides. Mortises 118 are also generally the same size and each have a plurality of substantially flat sides. End tenons 116A and inner tenons 116B include a portion 122 of inner rigid panel 104 and a portion 124 of foam core 108. The tenons 116A and 116B, and mortises 118 extend length wise toward end portion 120 of SIP 100 and have side faces 125, except for mortises 118 adjacent end tenons 116A that have one side face 125 and a second face side of internal side 140 of the adjacent end tenon 116A. Tenons 116A and 16B also include end faces 141A and 141B, respectively that extend generally normal to the plane of SIP 100. Side portions 126 and 130 of SIP 100 are substantially parallel to one another. Side portion 126 includes a side end facing surface 128 and side portion 130 includes a side end facing surface 132, side end facing surfaces 128 and 132 are substantially parallel to each other at the substantially the same angle. Inner tenons 116B have a dovetail shape when viewed from facing end portion 120 of SIP 100 (i.e., viewing the thickness of SIP 100) and form a generally trapezoid shape, each tapered normal to the plane of SIP 100 and such that outer edge 134 is narrower than inner edge 136, the latter being coincident with the exterior surface 137 of inner rigid panel 104. End tenons 16A have a half dovetail and each includes an external side 138 and an internal side 140. Internal sides 140 are tapered normal to the plane of SIP 100 such that outer edge 142 of end tenons 116A is narrower than inner edge 144, the latter being coincident with the exterior surface 137 of inner rigid panel 104. External sides 138 of end tenons 16A are not tapered and are substantially parallel to side portions 126 and 130 and substantially normal to the plane of SIP 100. As a result of the shape of tenons 16A and 16B, mortises 118 also have a generally dovetail shape when viewed from facing end portion 120 of SIP 100 (i.e., viewing the thickness of SIP 100) which forms a generally trapezoid shape and each are tapered normal to the plane of SIP 100 such that outer edge 143 is wider than inner edge 145. Mortises 118 are defined by the side faces 125 of the inner tenons 116B on either side thereof or a side face 125 of an inner tenon and internal side 140 of end tenons 116A as well as an inner face 149 and a root face 151. Root face 151 is in substantially the same plane as SIP 100 and inner face 149 extends substantially normal to the plane of SIP 100. Root face 151 in some embodiments may expose a portion of the interior surface 153 of outer rigid panel 106. The outer rigid panel 106 of SIP 100 also includes a beveled surface 146 along the length of end portion 120, the beveled surface 146 having an outside edge 133 and an inside edge 135, the outside edge 133 coincident with the exterior surface 155 of the outer rigid panel. The beveled surface 146 is beveled to substantially match the angle of side end facing surfaces 128 and 132. The end faces 141A and 141B of tenons 16A and 116B are substantially normal to the plane of SIP 100 and coincident with the inside edge 135 of beveled surface 146. The width of tenons 16A and 16B depends on the length of end portion 120 and the overall size of the SIP, but inner edge 144 of tenons 16A and inner edge 136 of tenons 16B generally range in width of from about 3 in. to about 3 ft.

SIP 102 also include a plurality of tenons 148 and a plurality of mortises 150A and 150B that alternate and are positioned along the length of end portion 152 that is one perimeter side of the SIP such that end mortises 150A are positioned adjacent side portions 162 and 166 with inner mortises 150B positioned therebetween along the length of end portion 152. Side portions 162 and 166 are each along two other perimeter sides of the SIP, each of the side portions abutting the end portion 152 at one end thereof. Tenons 148 are all generally the same size and each have a plurality of substantially flat sides. Inner mortises 150B are also generally the same size and each have a plurality of substantially flat sides. End mortises 150A are both generally the same size and each have a plurality of substantially flat sides. Tenons 148 include a portion 154 of inner rigid panel 110 and a portion 156 of foam core 114. Tenons 148 and mortises 150B extend length wise toward end portion 152 of SIP 102 and have side faces 158 that extend generally normal to the plane of SIP 102. Tenons 148 also each include an end face 174 that extends generally normal to the plane of SIP 102. 162 and 166 of SIP 102 are substantially parallel to one another. Side portion 162 includes a side end facing surface 164 and side portion 166 includes a side end facing surface 168, side end facing surfaces 164 and 168 are substantially parallel to each other at the substantially the same angle. Tenons 148 have a dovetail shape when viewing in the plane of SIP 102 (i.e., inner rigid panel 110 of SIP 102) forming a generally trapezoid shape and each are tapered in the plane of SIP 102 (i.e., inner rigid panel 110 of SIP 102) such that inside width 170 is narrower than end width 172. As a result of the shape of tenons 148, inner mortises 150B have a dovetail shape which forms a generally trapezoid shape and each are tapered in the plane of SIP 102 (i.e., inner rigid panel 110 of SIP 102) such that outer width 171 is narrower than inner width 173. End mortises 150A have a half dovetail and each include an external side 175 and an internal side 177. Internal sides 177 are tapered such that outer edge 179 of end mortises 150A is narrower than inner edge 181, the latter being coincident with the exterior surface 183 of inner rigid panel 110. External sides 175 of end mortises 150A are not tapered, are substantially parallel to side portions 162 and 166, substantially normal to the plane of SIP 102 and are adjacent side end facing surfaces 164 or 168, depending on the side. Inner mortises 150A are defined by the side faces 158 of the tenons on either side thereof. Mortises 150A and 150B are also defined by an inner face 185 and a root face 187. Root face 187 is in substantially the same plane as SIP 102 and inner face 185 extends substantially normal to the plane of SIP 102. Root face 187 in some embodiments may expose a portion of the interior surface 189 of outer rigid panel 112. The outer rigid panel of SIP 102 also includes a beveled surface 182 along the length of end portion 152, the beveled surface 182 having an outside edge 178 and an inside edge 176, the outside edge 178 coincident with the exterior surface 190 of the outer rigid panel. The beveled surface 182 is beveled to substantially match the angle of side end facing surfaces 164 and 168. The end faces 174 of tenons 148 abut the inside edge 176 of beveled surface 182. The width of tenons 148 depends on the length of end portion 152 and the overall size of the SIP, but end width 172 generally range in length from about 3 in. to about 3 ft.

Figure 1C:
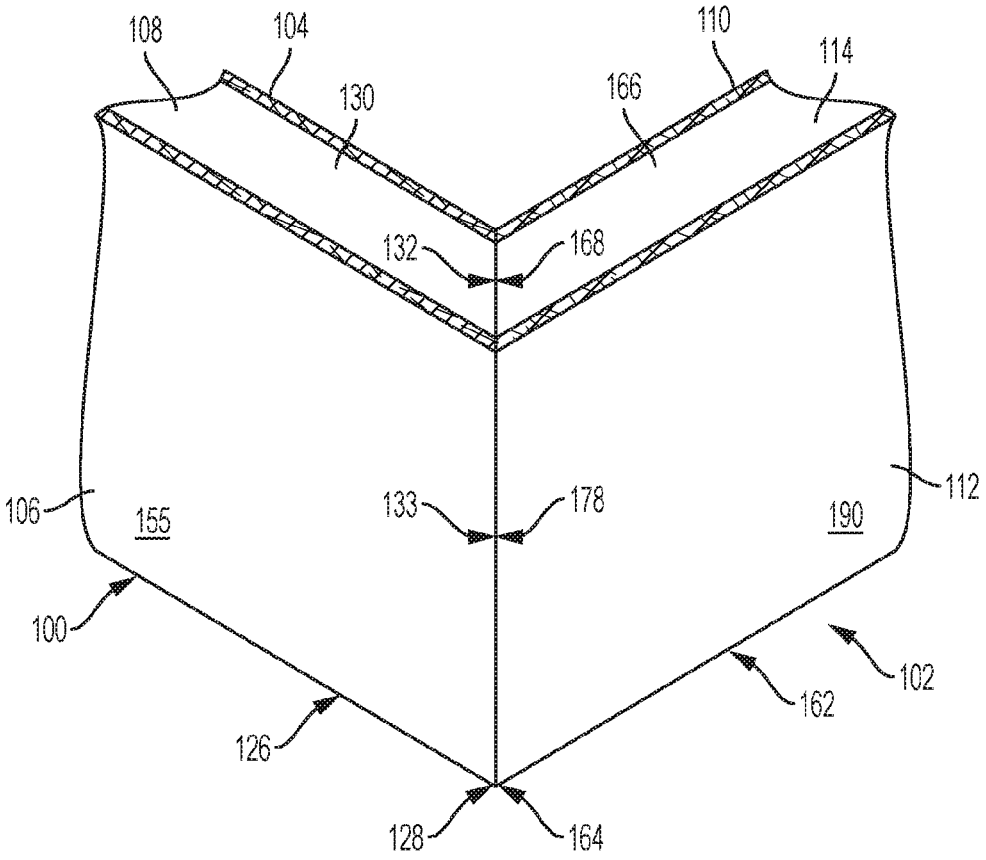
FIG. 1C is a perspective view illustrating the embodiments of the building panels of FIG. 1A and FIG. 1B joined.

When SIPs 100 and 102 are joined in FIG. 1C, side end facing surfaces 128 and 132 of SIP 100 and side end facing surfaces 164 and 168 of SIP 102 respectively abut one another, the tenons of SIP 100 fit into corresponding mortises of SIP 102, the tenons of SIP 102 fit into corresponding mortises of SIP 100 and SIP 100 end beveled surface 146 and SIP 102 beveled surface 182 respectively abut one another so that SIP 100 and SIP 102 when joined are at a substantially 90° angle to one another. Also, providing side end facing surfaces 128 and 132 of SIP 100 and side end facing surfaces 164 and 168 of SIP 102 and dovetails that only extend partially through the thickness of the SIPs, for example, tenons and mortises of SIPs 100 and 102 extend substantially through the inner rigid panel and foam core of each SIP and not substantially into the outer rigid panel (in one embodiment), just to the inner surface of the outer rigid panel (in another embodiment) or substantially but not completely through the foam core (in yet another embodiment), the joint is hidden. Such a joint may be referred to as a secret or hidden dovetail.

An embodiment of the joint formed by SIPs 100 and 102 may include the joint features being formed before or during the assembly of the SIP units from the component parts thereof (including e.g., inner rigid panel 104, outer rigid panel 106 and foam core 108 of SIP 100 and inner rigid panel 110, outer rigid panel 112 and foam core 114 of SIP 102). Alternatively, the joint features may be formed during a manufacturing process of modifying an already formed SIP by cutting the components of the already formed SIP unit (including e.g., inner rigid panel 104, outer rigid panel 106 and foam core 108 of SIP 100 and inner rigid panel 110, outer rigid panel 112 and foam core 114 of SIP 102). In one embodiment, when cutting or forming the joint features, the tenons and mortises of SIPS 100 and 102 may extend through the inner rigid panel and foam core of each SIP and not substantially into the outer rigid panel. Also, the joint features that are part of the foam core are formed to be "proud" such that either the foam core portions of the tenons are slightly larger than required in the design specifications, the foam core portions of the mortises are slightly larger than required in the design specifications or both are present such that there is a snug fit between the joined SIPs, thereby providing a joint that substantially resistant to water and air migrating through the joint from the exterior of the joint to the interior and vice versa. Such size difference between the connecting foam portions of tenons and mortise (individually or together) may range from about 1/32 in. to about 1/4 in., preferably about 1/16 in.

The angle of edges 128 and 132 of SIP 100 and edges 164 and 168 of SIP 102 may be at approximately 450 relative to the plane of their respective outer rigid panel. As a result, when the embodiment of SIPs 100 and 102 are joined, SIP 100 is positioned at about a 90° angle to SIP 102. In other embodiments, the angles of edges 128 and 132 of SIP 100 and edges 164 and 168 of SIP 102 as well as the tenons and mortises thereof can be altered if the desired angle of the joined SIPs is different from 900.

Figure 2A:
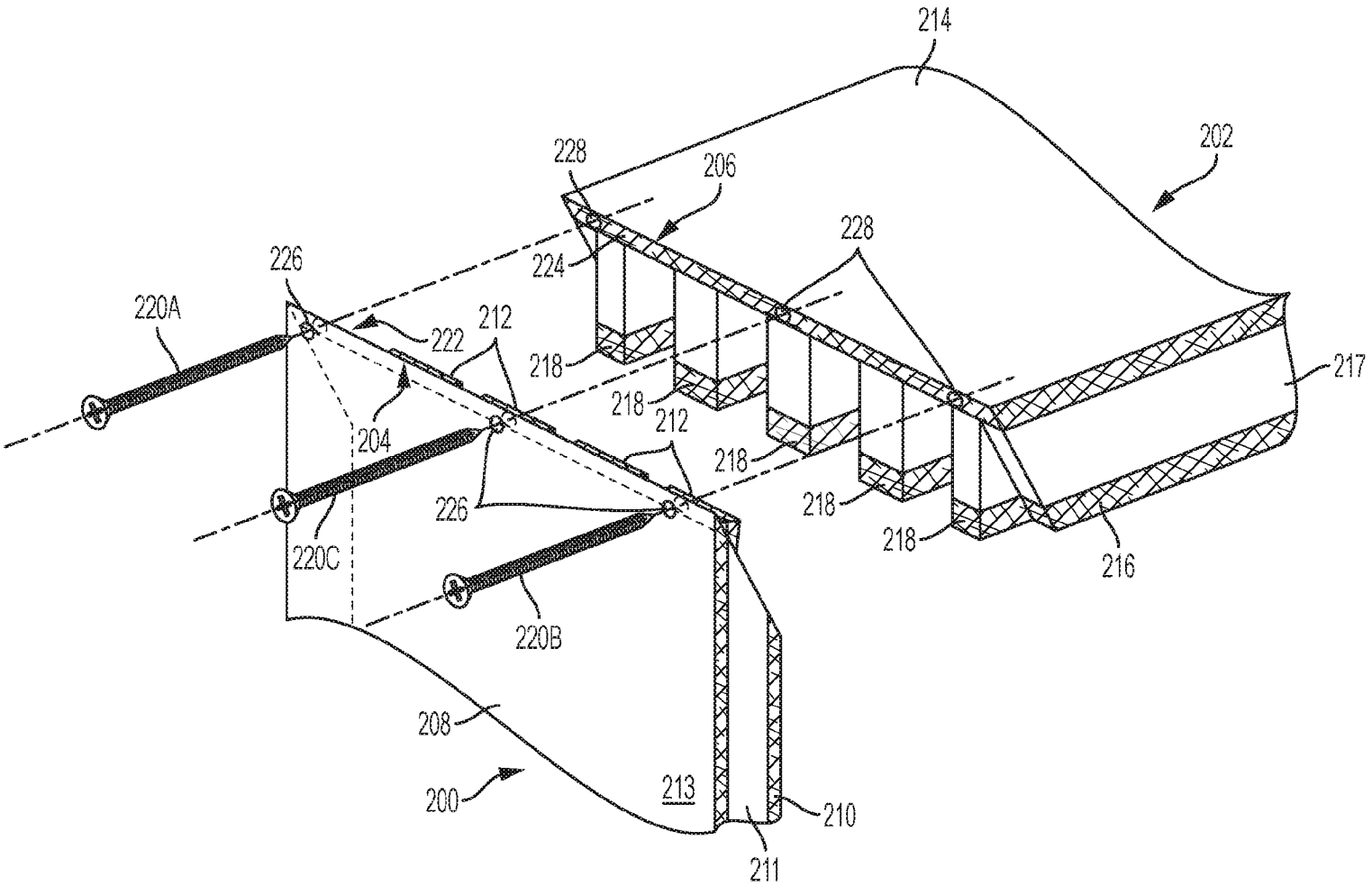
FIG. 2A is an exploded perspective view illustrating another embodiment of two building panels to be joined.
Figure 2B:
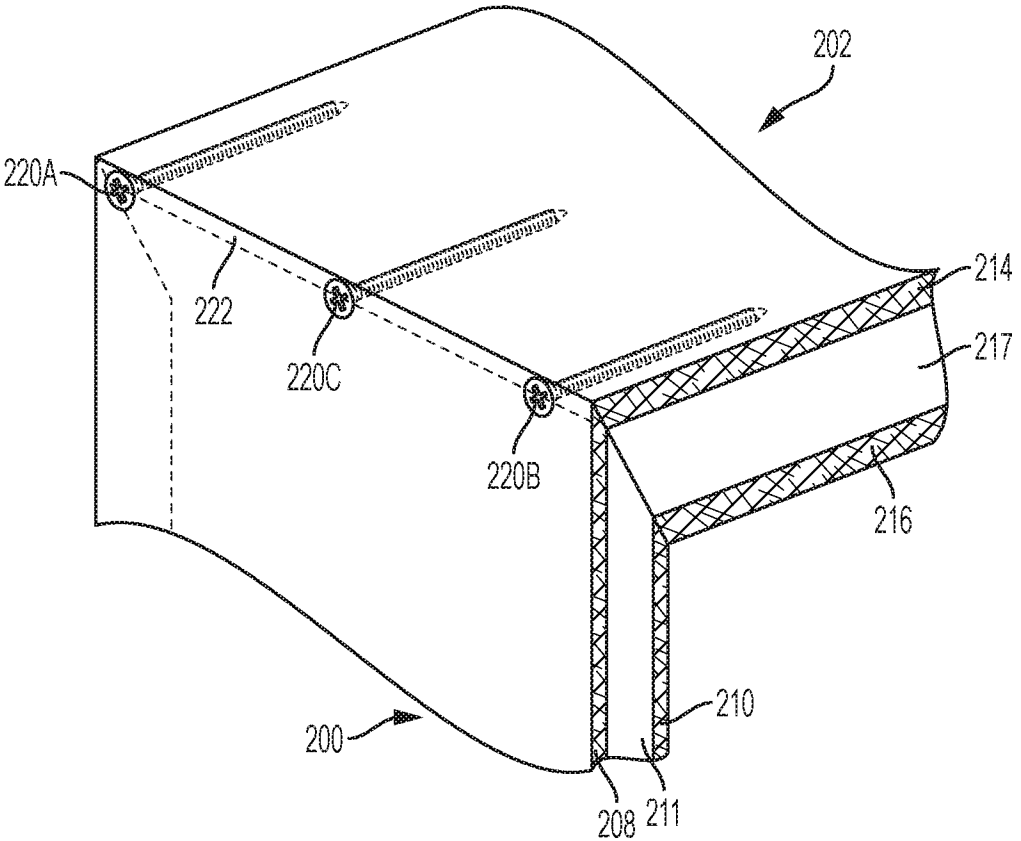
FIG. 2B is a perspective view illustrating the embodiment of FIG. 2A where the two building panels are joined.

Another embodiment is illustrated in FIGS. 2A and 2B in which SIPs 200 and 202 are joined using a similar joint to that of the embodiment of FIG. 1. SIPs 200 and 202 are positioned at about 90° to one another with SIP 200 having a tenon/mortise configuration along end portion 204 similar to SIP 102 in FIG. 1B and SIP 202 having a tenon/mortise configuration along end portion 206 similar to SIP 100 in FIG. 1A. SIP 200 includes outer rigid panel 208 having an exterior surface 213, inner rigid panel 210, foam core 211 and tenons 212. SIP 202 includes outer rigid panel 214, inner rigid panel 216, foam core 217 and tenons 218. FIGS. 2A and 2B also includes screws 220A and 220B that are inserted adjacent the corner ends of side 204 of SIP 200 and screw 220C inserted at approximately the middle of side 204. Screws 220A, 22B and 220C are inserted into the exterior surface 213 of outer rigid panel 208, through beveled surface 222 of SIP 200, through beveled surface 224 of SIP 202 and into the outer rigid panel 214 of SIP 202. The screws may be inserted with or without pre-drilled holes in one or both of SIPs 200 and 202, preferably the screws are inserted into pre-drilled holes in one of the SIPs, more preferably the screws are inserted into pre-drilled holes in both SIPs. Inserting the screws through the beveled surface 224 of SIP 202 through the beveled surface 222 of SIP 200 and into the outer rigid panel 208 of SIP 200 may not be workable in this embodiment, as the joint is pulled together by the screws, and panel 202 cannot be inserted into panel 200. The embodiment of FIG. 2B illustrates once SIPs 200 and 202 are brought together and jointed with screws 220A, 220B and 220C. The length of the screws is at least twice the thickness of one of the SIPs into which they are inserted. Preferably, the screws are at least about 12 in. long. The diameter of the helical flight portion of the screw may be less than the thickness of the SIP outer panel. Pre-drilled holes referred to above may be slightly smaller in diameter compared to the diameter of the helical flight portion of the screw. The diameter of the head of the screw may be larger than the diameter of the helical flight portion of the screw so as to minimize splitting or other compromise of the structural integrity of either outer rigid panel. Preferably, the diameter of the head of the screw may be at least two times, more preferably three times and even more preferably four times the diameter of the helical flight portion of the screw. Although the embodiment of FIGS. 2A and 2B include three screws, in addition to one screw at each corner and one in the middle, additional screws approximately every 18 inches on both sides of the middle screw may be included in one embodiment, every 12 inches in another embodiment and every 6 inches in still another embodiment.

An alternative embodiment to securing an SIP joint with screws may include inserting each screw into the outer panel and through a tenon of a first SIP, through a mortise of a second SIP and into the foam core and a plywood board or other building material board in the second SIP. The board is positioned parallel to the mortises of the second SIP where it may be embedded in the foam of the second SIP. The board is also positioned adjacent the mortises or a sufficient distance in from the mortises of the second SIP such that the screws are of sufficient length to firmly engage the board and sufficiently secure the joint between the two SIPs. The screws may be inserted with or without pre-drilled holes in one or both of the SIPs. preferably the screws are inserted into pre-drilled holes in one of the SIPs, more preferably the screws are inserted into pre-drilled holes in both SIPs. The length of the screws is at least twice the thickness of one of the SIPs into which they are inserted. Preferably, the screws are at least about 12 in. long. Pre-drilled holes referred to above may be slightly smaller in diameter compared to the diameter of the helical flight portion of the screw. The diameter of the head of the screw may be larger than the diameter of the helical flight portion of the screw so as to minimize splitting or other compromise of the structural integrity of either outer rigid panel. Preferably, the diameter of the head of the screw may be at least two times, more preferably three times and even more preferably four times the diameter of the helical flight portion of the screw. As with the previous embodiment, in addition to one screw proximate to each corner of the first SIP and one in the middle, additional screws approximately every 18 inches on both sides of the middle screw may be included in one embodiment, every 12 inches in another embodiment and every 6 inches in still another embodiment. More than one screw per tenon of the first SIP may also be used.

In order to effectuate an efficient joining of SIP 200 and 200 in FIG. 2A, an embodiment for joining the SIPs may include inserting the screws into SIP 200 beyond the inner rigid panel 210 of SIP 200. SIP 202 is then positioned at a 90° angle to SIP 200 and so that its components (tenons and mortises) are positioned adjacent the corresponding components of SIP 200 to which they will be inserted. Each screw is rotated until it is engaged with the top beveled edge 224 of SIP 202 and into the outer rigid panel 214 of SIP 202. Next the screws are rotated gradually (e.g., from 5 to 20, preferably 10 to 15 turns depending on the size of the screw), each being rotated the same amount until all the screws have been rotated. Next, the process of rotating each screw, each the same amount, is repeated until SIPs 200 and 202 are joined in a snug joint. The process of rotating each screw approximately the same number of turns gradually brings the two SIPs together while minimizing bending, cracking, warping or other stress or damage to either SIP during the joining process. In another embodiment, a second set of screws may be inserted through the top beveled edge 222 of SIP 200 through the top beveled edge 224 of SIP 202 and into the outer rigid panel 214 of SIP 202 to secure the already formed joint. The screws may be turned by hand using, for example, a screw driver and by machine using, for example, a motorized screw driver.

Another embodiment may also include electrical/telecommunication components including conduits and associated equipment (e.g., electrical cable and wiring, telecommunications cable including cable TV, fiber optic cable, junction boxes, connectors, switches, etc.) as well as plumbing components including conduits and associated equipment and HVAC (heating, ventilating and air conditioning) components including conduits and associated equipment (e.g., wiring for and between thermostats and other HVAC equipment including duct work, air conditioning units, furnaces, etc.). Telecommunication conduits may include wiring or cable for telephone, internet, intercom, etc. Electrical conduits may include electrical power conduits (e.g., wiring, cable, etc.). Plumbing conduits may include piping (rigid, e.g., copper or flexible, e.g., PVC and PEX) suitable of conveying fluids. Such electrical/telecommunication, plumbing and HVAC components can be included in an SIP when obtained from the SIP manufacturer or installed in the SIP during the process of modifying an already formed SIP. In either case, the desired electrical/telecommunication, plumbing and HVAC components may be preferably installed in the SIP prior to forming the elements of the dovetail joint. Electrical/telecommunication components, plumbing components and HVAC components can be included in any SIP sections of a building, however, it is best not to include SIPs including plumbing components and HVAC components, in particular plumbing components, as part of a building's exterior walls because exposure to the outside environment may have an adverse effect on those components and the contents thereof. For example, cold temperatures outside a building can have an adverse effect (e.g., freezing during the cold weather months (winter)) on such plumbing components and their fluid contents.

Figure 3A:
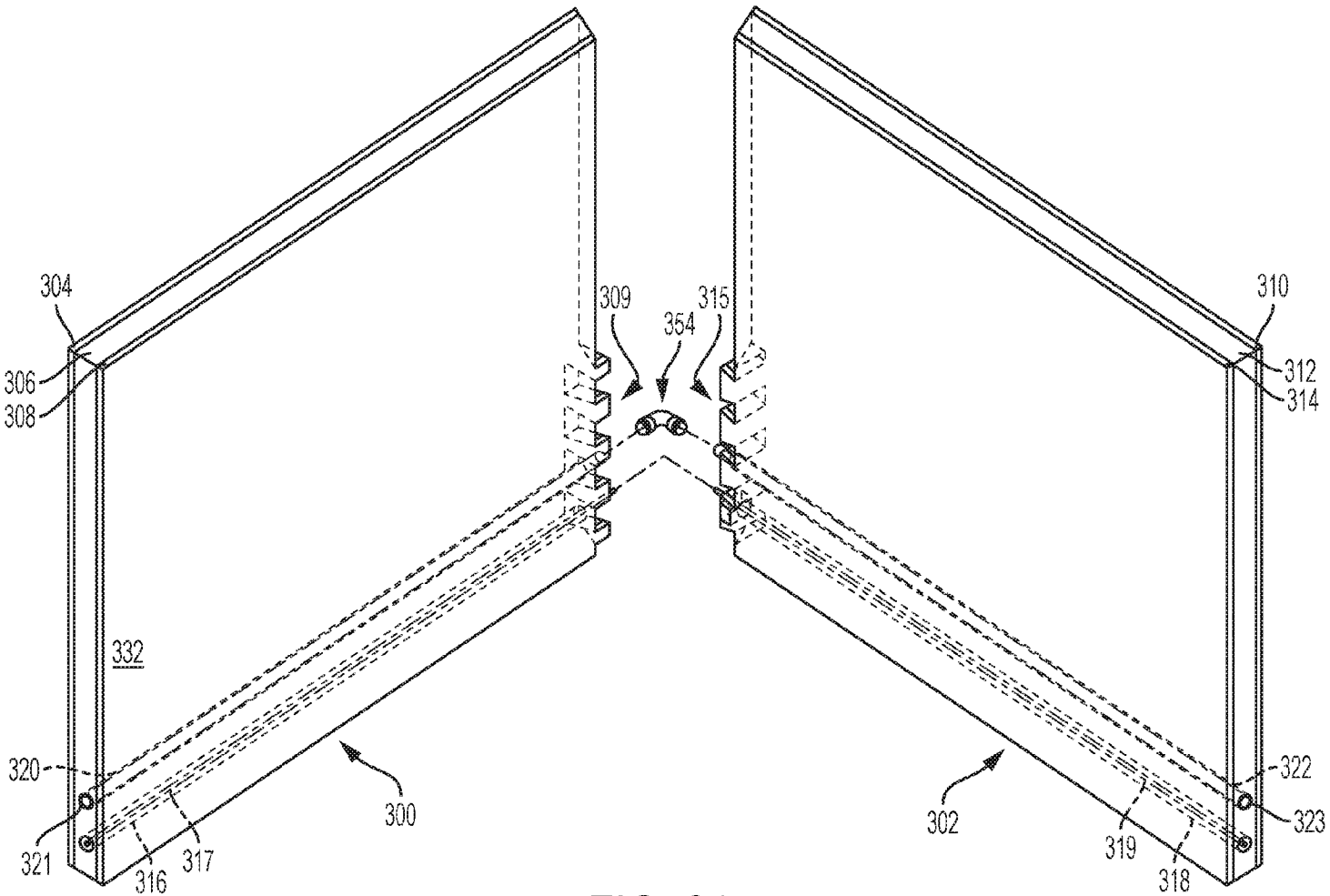
FIG. 3A is an exploded perspective view illustrating another embodiment of two building panels to be joined.
Figure 3B:
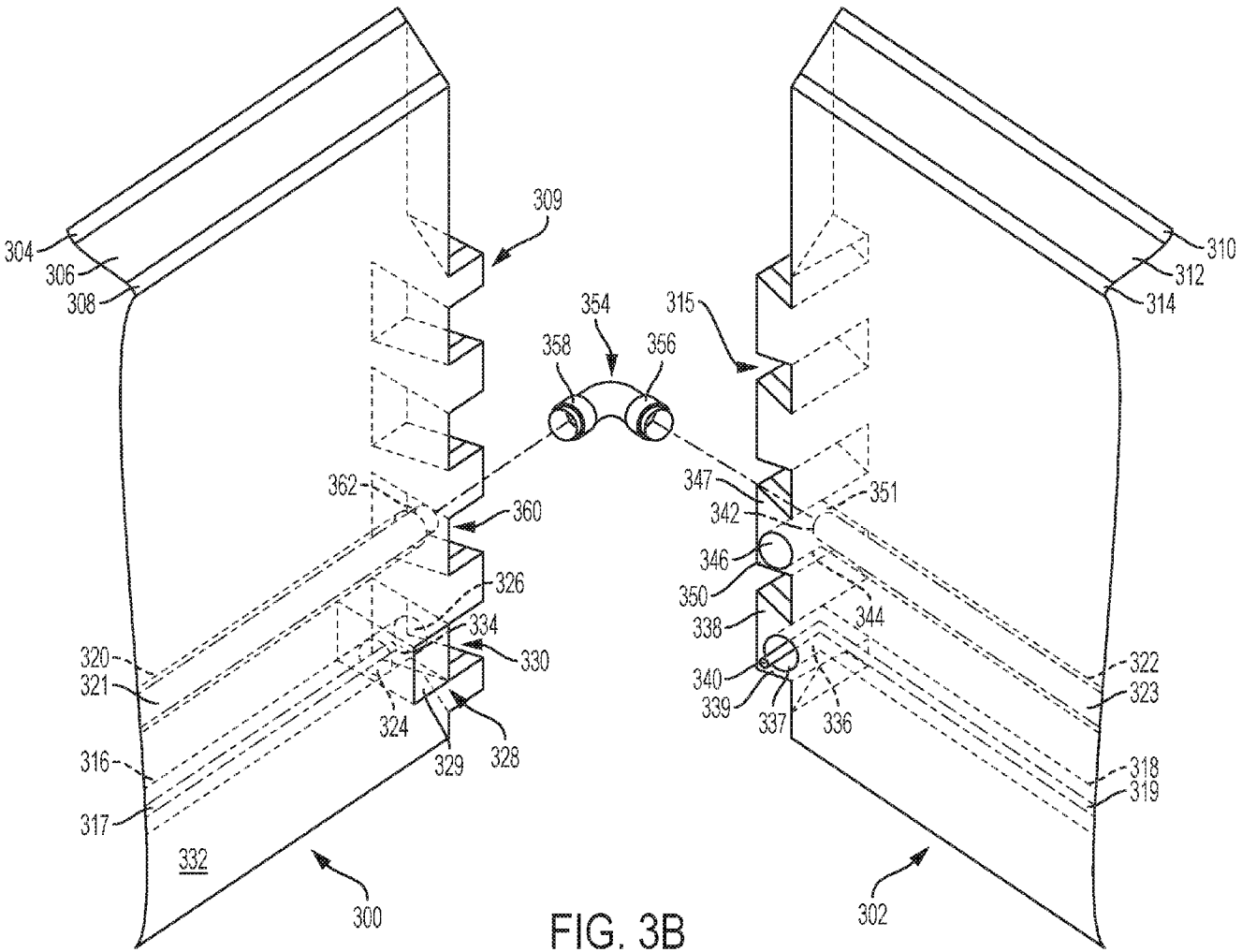
FIG. 3B is an enlarged exploded perspective view illustrating the embodiment of FIG. 3A.

FIGS. 3A and 3B includes an embodiment of an SIP including an electrical/telecommunication conduit and a plumbing conduit, however, either one or neither or multiples of each may be included. FIGS. 3A and 3B include SIPs 300 and 302. SIP 300 includes outer rigid panel 304, foam core 306, inner rigid panel 308 and a plurality of tenons and mortises 309 along one side. SIP 302 includes outer rigid panel 310, foam core 312, inner rigid panel 314 and a plurality of tenons and mortises 315 along one side. The plurality of tenons and mortises 309 and the plurality of tenons and mortises 315 are positioned so that SIPs 300 and 302 can be joined as describe herein. SIPs 300 and 302 can each include an electrical/telecommunication passage or chase 316 and 318 respectively for an electrical/telecommunication conduit such as wiring or cable and a plumbing passage or chase 320 and 322 respectively for a plumbing conduit such as piping or plumbing conduits 321 and 323, respectively. Electrical/telecommunication chases 316 and 318 include wiring 317 and 319 respectively, the wiring as part of an electrical or telecommunication network in the structure for which SIPs 300 and 302 are part thereof. Electrical/telecommunication chases 316 and 318 may also include a non-conductive or other housing therein into which wiring 317 and 319 are placed in order to meet special requirements required by government building and electrical codes.

SIP 300 may also include junction box 328 through which wiring 317 may pass entering through box aperture 324, box aperture 324 being on one side of junction box 328 into which wiring 317 can be inserted. Junction box 328 includes a covered access opening 329. Junction box 328 can be positioned in a cavity in the inner rigid panel 308 and foam core 306 of SIP 300 at the end of electrical/telecommunication passage or chase 316 and adjacent to mortise 330. Such positioning of junction box 328 may allow wiring end 334 of wiring 317 to extend from electrical/telecommunication passage or chase 316 into junction box 328 through box aperture 324. Another box aperture 326 in junction box 328 may be open and accessible through mortise 330 and covered access opening 329 may be located on the exterior surface 332 of inner rigid panel 308 in order to provide access to the interior of junction box 328 by removing the cover of the covered access opening 329. For SIP 302, a channel 336 with open end 337 is formed in side 339 of tenon 338, channel 336 is open to electrical/telecommunication chase 318 such that wiring end 340 of wiring 319 can extend from electrical/telecommunication chase 318 through and out of channel 336 through open end 337. Channel 336 may also include a non-conductive or other housing therein into which wiring is placed in order to meet special requirements required by government building and electrical codes. Open end 337 is flush with the exterior surface of side 339 of tenon 338 so that when SIPs 300 and 302 are joined and tenon 338 is close fit and snug positioned in mortise 330 and open end 337 is accessible to box aperture 326 such that wiring end 334 of wiring 317 and wiring end 340 of wiring 319 can be joined via, for example, opening covered access opening 329 of junction box 328.

When SIPs 300 and 302 are joined and tenon 338 is inserted into mortise 330, open end 337 is positioned adjacent the box aperture 326 injunction box 328. During the joining procedure, wiring end 340 of wiring 319 from SIP 302 can be inserted into junction box 328 such that during or after the joining procedure, wiring ends 334 and 340 can be accessed and connected using known methods, for example, via the covered access opening 329 of junction box 328.

For the joining of plumbing conduits of SIPs 300 and 302, Plumbing chase 322 of SIP 302 includes a rigid plumbing conduit 323 with plumbing conduit end 342. A channel 344 is formed in tenon 347 with open end 346 formed in side 350 of the tenon, channel 344 connected to a cavity 351 in tenon 347. Plumbing chase 322 does not extend into cavity 351, the latter being of sufficient size to house elbow joint 354, which may be preferably a push-to-connect elbow joint therein. At least one of channel 344 and cavity 351 may be open to the side of tenon 347 facing elbow joint 354 in the figure so that elbow joint 354 may be positioned in channel 344 and cavity 351 to engage with plumbing conduit 323 as discussed below. Plumbing conduit end 342 may extend a sufficient distance into cavity 351 to securely engage with end 356 of elbow joint 354 when the latter is positioned in channel 344 and cavity 351. When positioned in cavity 351, end 358 of elbow joint 354 may extend through channel 344 and out open end 346. Plumbing chase 320 of SIP 300 opens into mortise 360 and includes a rigid plumbing conduit 321 with plumbing conduit end 362. Plumbing conduit end 362 extends sufficiently into mortise 360, end 358 of elbow joint 354 extends out of open end 346 of a sufficient distance past open end 346 and open end 346 of channel 344 is appropriately positioned so that when SIPs 300 and 302 are joined and tenon 347 is inserted into mortise 360, end 358 of elbow joint 354 and plumbing conduit end 362 are sufficiently proximate to one another that plumbing conduit end 362 can be securely engaged with end 358 of elbow joint 354 during the process of joining SIPs 300 and 302. Also, open end 346 of channel 344 and the end of plumbing chase 320 that opens into mortise 360 may be positioned so that plumbing conduit end 362 can be securely engaged with end 358 of elbow joint 354 during the process of joining SIPs 300 and 302.

As an alternative embodiment, for example, should the plumbing conduit used be a flexible plumbing conduit, cavity 351 and elbow joint 354 may not be necessary. In this alternative embodiment, channel 344 is formed in tenon 347 with open end 346 formed in side 350 of tenon 347 and channel 344 is open to plumbing chase 322 such that plumbing conduit end 342 can extend from plumbing chase 322 out of channel 344 through open end 346 and plumbing conduit end 362 extends sufficiently into mortise 360 that the two conduit ends can be joined using known methods, such as for example, known adhesive or connector methods, as SIPs 300 and 302 are in the process of being joined before the joining is completed.

There may be embodiments with more than one electrical/telecommunication chase and more than one plumbing chase per panel or pair of joined panels. Electrical wiring and telecommunications wiring can preferably be in separate chases. Plumbing chases that include conduits for hot fluid and conduits of room temperature or cold fluid can preferably be housed in separate plumbing chases. Electrical/telecommunication chases and plumbing chases like those illustrated in FIGS. 3A and 3B as well as chases for HVAC can be positioned in an SIP as horizontal, vertical, angled or a mixture of any two or all three. Preferred orientation between wall jointed SIP wall sections is mostly horizontal. The Electrical/telecommunication, plumbing or HVAC chases may be formed in the foam layer of the SIP before or during the assembly of the SIP units from the component parts thereof, installed, drilled or otherwise formed or installed in an existing SIP during the process of modifying of an already formed SIP using, for example, a hot knife.

Associated electrical/telecommunications equipment (such as, for example, electrical plugs, electrical switches, and connectors for telecommunications cable), associated HVAC equipment (such as, for example, thermostats) and associated plumbing equipment (such as, for example, external plumbing valves, connection to appliances, e.g., dish washers) where access to electrical/telecommunications, HVAC or plumbing equipment within the SIP is needed can be achieved by cutting an access port in the inner rigid panel and any necessary foam core material of the SIP proximal to the conduit where the latter is located. A desired connection or conduit can (e.g., electrical plugs, electrical switches, connectors for telecommunications cable, thermostats and associated plumbing equipment (such as, for example, external plumbing valves, connection to appliances) be used to connect to the electrical/telecommunications, HVAC or plumbing conduit in the SIP and the desired connection may be attached to the inner rigid panel into which the access port is cut in order to secure it to the SIP.

Figure 4B:
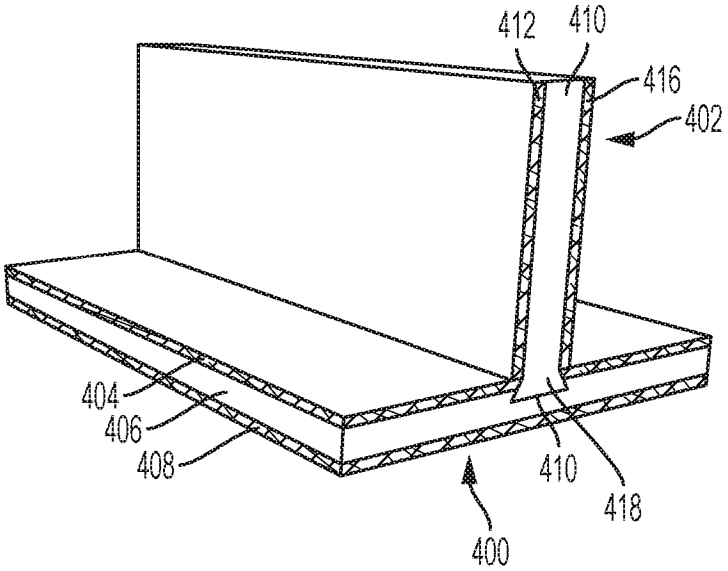
FIG. 4B is a perspective view illustrating the embodiment of FIG. 4A where the building panel and floor panel are joined.
Figure 4A:
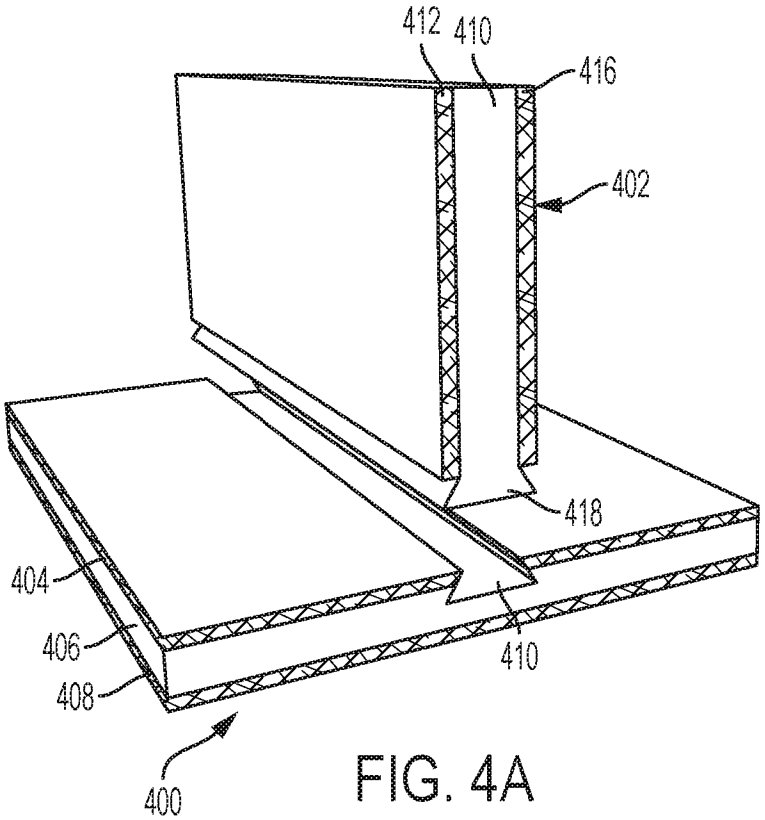
FIG. 4A is an exploded perspective view illustrating an embodiment of a wall building panel and floor building panel to be joined.

SIPs can be mounted to floor panel or other floor sections of a building. One embodiment is illustrated in FIGS. 4A and 4B. FIGS. 4A and 4B include a floor section, for this illustration a floor SIP 400 and a wall SIP 402. SIP 400 includes a top rigid panel 404, foam core 406, bottom rigid panel 408 and sliding dovetail mortise 410. SIP 402 includes a left rigid panel 412, foam core 410, right rigid panel 416 and sliding dovetail tenon 418. Sliding dovetail tenon 418 runs the length of base of SIP 402 and is tapered and of a suitable size to snugly fit into sliding dovetail mortise 410 of SIP 400 that is a tapered slot of suitable size to snugly fit sliding dovetail tenon 418. In the illustrated embodiment, sliding dovetail tenon 418 is positioned to engage with a portion of sliding dovetail mortise 410 and the two are slid into place. In FIGS. 4A and 4B, wall SIP 402 is positioned in the middle of floor SIP 400. However, a similar sliding dovetail configuration can be used to mount a wall SIP at other positions, such as, for example, closer to the perimeter of a floor SIP. Other embodiments may include other forms of wall to floor attachment including, for example, standard tenon to mortise attachment.

There may be an embodiment where windows & doors are installed in an SIP either during the assembly of the SIP units from the component parts thereof (e.g., inner rigid panel 104, outer rigid panel 106 and foam core 108 of SIP 100 and inner rigid panel 110, outer rigid panel 112 and foam core 114 of SIP 102) or during the manufacturing process of modifying an already formed SIP, including for example, forming the joint features and electrical/telecommunication, HVAC or plumbing passages or chases. Windows or doors could be installed by forming or cutting an opening in the SIP through the inner rigid panel, foam core and outer rigid panel of a suitable size and dimension and inserting a pre-hung door or window therein with caulk or other means of attachment.

An embodiment of a manufacturing process of modifying an already formed SIP can be accomplished using an assembly line including a plurality of stations where the various modifications can take place. Another embodiment of a manufacturing process of modifying an already formed SIP can be accomplished using an assembly line including a plurality of stations where the various modifications that take place may include robots that can perform some or all of the needed tasks or steps to modify the already formed SIP.

An embodiment of a process for constructing a structure using the SIPs can be accomplished using robots to join the SIPs as well as install and join flooring material and pre-hang and install drywall. This embodiment may also include an online interface for builders and architects to create and enter a floor plan and/or structure or parts thereof that could be passed on to the above manufacturing process of modifying an already formed SIP to manufacture the SIPs needed for the construction of the created floor plan and/or structure or parts thereof. The SIPs manufactured can then be packaged or stacked onto pallets and transported (for example, by truck and/or rail) to the construction site for assembly.

This written description uses examples as part of the disclosure, including the best mode, and also to enable any person skilled in the art to practice the disclosed implementations, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A building panel comprising:

an inner rigid panel including an exterior surface;

an outer rigid panel including an exterior surface;

a foam core therebetween the inner rigid panel and the outer rigid panel;

four perimeter sides;

an end portion along one perimeter side of the building panel;

two side portions each along two other perimeter sides of the building panel, each of the side portions abutting the end portion at one end thereof; and a dovetail configuration along the end portion, the dovetail configuration including the outer rigid panel having a beveled surface along the length of the end portion, the beveled surface having an outside edge and an inside edge, the outside edge coincident with the exterior surface of the outer rigid panel;

each side portion including a side end facing surface at substantially the same angle as the beveled surface of the outer rigid panel and extensive of the beveled surface from the inside edge of the beveled surface at one end of each side end facing surface, the side end facing surface including an inner rigid panel portion and a foam core portion; and a tenon and mortise dovetail along the length of the end portion in between the side portions, the tenon and mortise dovetail comprising a plurality of tapered tenons and a plurality of tapered mortises in one of two configurations:

a first configuration wherein the plurality of tapered tenons include inner tenons and end tenons, each inner tenon and end tenon including a plurality of substantially flat sides comprising an interior face that is coplanar to and includes the exterior surface of the inner rigid panel, two side faces normal to the interior face that include an inner rigid panel portion and a foam core portion and an end face normal to the interior face that include an inner rigid panel portion and a foam core portion, each inner tenon positioned between two mortises on either side thereof, each end tenons positioned adjacent one of the side end facing surfaces of the side portions, the two side faces of each end tenon including an internal side face and an external side face, the external side face positioned adjacent the side portion of one of the side end facing surfaces; and each mortise of the plurality of tapered mortises includes a plurality of substantially flat sides defined by the side faces of tenons on either side thereof, a root face normal to the inside edge of the outer rigid panel's beveled surface and an inner face normal to the exterior surface of the inner rigid panel, the root face including an inner rigid panel portion and a foam core portion; and a second configuration wherein each tenon of the plurality of tenons includes a plurality of substantially flat sides comprising an interior face that is coplanar to and includes the exterior surface of the inner rigid panel, two side faces normal to the interior face, each side face including an inner rigid panel portion and a foam core portion and an end face normal to the exterior face that includes an inner rigid panel portion and a foam core portion; and the plurality of tapered mortises include inner mortises and end mortises, each inner mortise and end mortise includes a plurality of substantially flat sides defined by a root face normal to the inside edge of the outer rigid panel's beveled surface and an inner side normal to the exterior surface of the inner rigid panel, the root face including an inner rigid panel portion and a foam core portion, each inner mortise further defined by the side faces of tenons on either side thereof, the end mortises further defined by the side face of a tenon on one side and an inner wall of the side end facing surface on the other.

2. The building panel according to claim 1 wherein the inner rigid panel and the outer rigid panel are a gypsum composite, a cementitious composite, plywood, oriented strand board or drywall and the thickness of each inner rigid panel and outer rigid panel range from ¼ in. to ¾ in.

3. The building panel according to claim 1 wherein the tenon and mortise dovetail is the second configuration and further including a plurality of screw holes along the length of the end portion from an exterior surface of the outer rigid panel through the beveled surface thereof.

4. The building panel according to claim 1 wherein the tenon and mortise dovetail is the first configuration and further including a plurality of screw holes along the length of the end portion through the beveled surface outer rigid panel and into the outer rigid panel.

5. The building panel according to claim 3 wherein the plurality of screws holes are positioned with one screw hole at each corner of the end portion and one screw hole in the middle of the end portion.

6. The building panel according to claim 4 wherein the plurality of screws holes are positioned with one screw hole at each corner of the end portion and one screw hole in the middle of the end portion.

7. The building panel according to claim 1 wherein the beveled surface of the outer rigid panel and the side end facing surface of each side portion are angled at approximately 45°.

8. The building panel according to claim 1 includes at least one channel extending through the foam core, said at least one channel suitable for containing plumbing or electrical conduits therein.

* * * * *